United States Patent [19]

Bell

[11] Patent Number: 4,703,697

[45] Date of Patent: Nov. 3, 1987

[54] TRANSPORTATION SYSTEM

[76] Inventor: George S. Bell, 4848 Deleon St., Ft. Myers, Fla. 33907

[21] Appl. No.: 7,282

[22] Filed: Jan. 27, 1987

Related U.S. Application Data

[63] Continuation-in-part of Ser. No. 602,120, Apr. 19, 1984, abandoned.

[51] Int. Cl.[4] ..... B61B 13/08; B60V 3/04

[52] U.S. Cl. ..... 104/23.1; 104/134

[58] Field of Search ..... 104/23.1, 23.2, 134, 104/138.1, 245; 105/1.1, 1.2; 246/187 B, 122 R; 364/434, 435

[56] References Cited

U.S. PATENT DOCUMENTS

| | | | |
|---|---|---|---|
| 442,508 | 12/1890 | Boynton | 104/23.1 X |
| 1,900,914 | 3/1933 | Cornet | 104/245 X |
| 2,976,820 | 3/1961 | Schaar | 104/23.1 X |
| 3,006,288 | 10/1961 | Brown | 104/23.1 |
| 3,444,823 | 5/1969 | Akmentin | 104/23.1 X |
| 3,498,234 | 3/1970 | Roumejon | 104/23.2 |
| 3,603,261 | 9/1971 | Mann | 104/23.1 X |
| 3,616,760 | 11/1971 | Lucien et al. | 104/23.2 |
| 3,675,582 | 7/1972 | Girard et al. | 104/23.1 |
| 3,721,198 | 3/1973 | Applegate | 104/23.1 |
| 3,805,056 | 4/1974 | Birkin | 246/187 B |
| 3,858,832 | 1/1975 | Baker | 246/187 B X |
| 3,921,946 | 11/1975 | Norton et al. | 246/187 B X |
| 4,171,115 | 10/1979 | Osder | 364/435 X |
| 4,302,811 | 11/1981 | McElhenny | 246/187 B X |

FOREIGN PATENT DOCUMENTS

| | | | |
|---|---|---|---|
| 1455022 | 1/1969 | Fed. Rep. of Germany | 104/23.1 |
| 1455016 | 1/1969 | Fed. Rep. of Germany | 104/23.1 |

*Primary Examiner*—Randolph A. Reese

*Attorney, Agent, or Firm*—Charles J. Prescott; Raymond H. Quist

[57] ABSTRACT

A transportation system is disclosed in which passenger carrying coaches are guided along paths defined by a trackway. The trackway has bottom, top and side tracks which limit movement of the coaches orthogonally to the trackway. The coaches proceed, for the most part, without touching the tracks, being supported by stub wings, mounted on pylons carried by the coaches. Motive power is supplied by a jet engine and primary control of a coach is by airfoil type control surfaces. Auxiliary control is supplied by nozzles which expel pressurized gas to provide corrective reactive forces. The position of a coach along the trackway is derived from location sensors carried by the coach, while the spacing of the coach from the trackway is derived from proximity sensors. The sensor signals are fed to central processing unit which compares this information with benchmark information contained in memory. The location information is used to command the motive power jet and flaps on the stub wings. The results of the proximity comparisons are used to produce consequential commands for the primary and auxiliary control systems. Retractable wheels cooperate with the associated tracks when the coach moves into close proximity. The trackways may be constructed in the dividing areas separating opposite traffic lanes of interstate highways.

10 Claims, 7 Drawing Figures

TRANSPORTATION SYSTEM

CROSS-REFERENCE TO RELATED APPLICATION

This application is a continuation-in-part of U.S. patent application Ser. No. 06/602,120, filed Apr. 19, 1984, now abandoned, for High Speed Streamlined Coach.

BACKGROUND OF THE INVENTION

1. Field of the Invention

This invention relates generally to a rapid, mass transporation system, and more particularly to such a system in which coaches travel for the most part in free flight within, but spaced from, a multitrack path.

2. Description of the Related Art

Contemporary rapid transit systems include the bus, which is subject to highway speed limitations. Fixed wing aircraft are useful for relatively long distances; however, their schedules are often unrealistic. Helicoptors and fixed wing aircraft are both subject to weather vageries, and helicoptors have been used commercially for only relatively short distances. The limitations of the foregoing systems have spurred the development of high speed trains which are in use in Japan and France. Such trains travel on rails which, for the most part, are supported by ties on a prepared bed. This mode of movement transmits to the cars and the occupants irregularities in the rail surface. Also, the propulsion is dependent upon friction between the drive wheels and the rails. This friction is reduced by the presence of moisture, ice or oil on the rails resulting in inefficient propulsion.

It is therefore and object of this invention to provide a transporation system which will rapidly and efficiently carry a multitude of passengers over prescribed paths.

In accordance with this and other objects, which will become apparent hereafter, the instant invention will now be described with reference to the accompanying drawings.

SUMMARY OF THE INVENTION

The invention is a long distance mass transportation system having streamlined coaches which are confined to travel through a multipath system along paths which may parallel those of a highway system. While the coaches are stopped, and during starting and stopping the coaches are supported by wheels on a pair of bottom rails of the trackway. At a predetermined relative wind speed the coaches become supported by stub wings supported on the top of the coaches by pylons and the coaches travel at high speed in a substantially free flight condition. The control of the flight paths of the coaches are accurately controlled by computer actuated mechanisms. The primary controls are airfoils. Secondary control is provided by blasts of gas or air. Wheels are also provided which can be urged against the tracks if the primary and secondary controls fail to provide sufficient correction of the coach path.

DESCRIPTION OF THE PREFERRED EMBODIMENT

Figures 1, 2, 3:
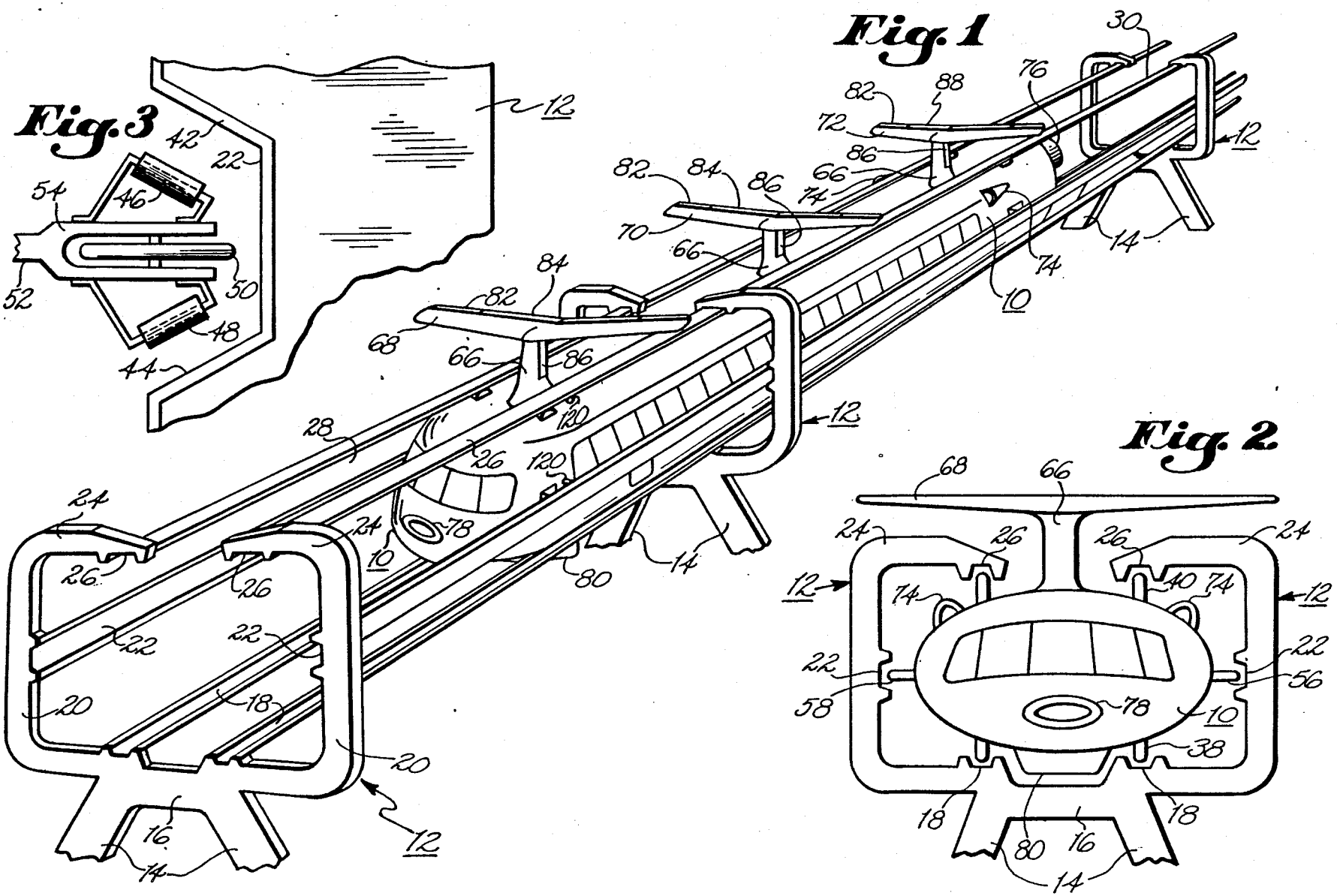
FIG. 1 is a perspective view illustrating the high speed coach in an "at rest" position within the trackway system.
FIG. 2 is a front elevational view of the coach in an "in flight" condition in the trackway system.
FIG. 3 is a fragmentary view illustrating the relation of the side wheels of the coach to the side tracks.

FIG. 1 is a perspective view which illustrates my streamlined high speed coach 10 positioned at rest within a trackway system, while FIG. 2 is an elevation showing coach 2 in an "in flight" condition. The trackway system is preferably mounted between the spaced land based vehicle lanes of a state or interstate highway system and consists of a series of spaced U-shaped framework members 12 having their upper ends turned inwardly and having an open top. Framework members 12 are supported by suitable abutments 14 which may be mounted in spaced bulwarks secured in solid foundations in the earth. Framework members 12 are quite massive and strong, and have horizontal bottom sections 16 which support bottom tracks 18. Framework members 12 have laterally spaced side members 20 which support side tracks 22, and at the top of side members 20 are short segments 24 extending inwardly which support top tracks 26. An open area 28 is provided at the top of framework members 12 between the inturned short segments 24.

It is thus apparent that there are six tracks supported by framework members 12. There are two tracks 18 at the bottom, for supporting coach 10 when it is at rest, when it is accelerating and when it is slowing down. There are two tracks 22 facing inwardly on side members 20, and two tracks 26 at the top facing downwardly. These side and top tracks help serve to keep coach 10 within the imaginary tunnel 30 formed by the six tracks.

The tracks 18 and 26 as illustrated in FIGS. 1 and 2 have concave central sections which extend laterally and terminate in outwardly extending flanges. Lower wheels 38 cooperate with tracks 18. Lower wheels 38 are in pairs, one on each side of coach 10 and are located at least near the front and rear of coach 10. Additional pairs of wheels may be used if the weight of coach 10 requires them. Wheels 38 may be provided with a retracting and extending system to decrease wind resistance. Such a system also permits the landing force of coach 10 to be absorbed over a longer period than if wheels 38 are held in a rigid position.

Upper wheels 40 cooperate with tracks 26, but are not normally in contact with tracks 26. During the time coach 10 is in flight, it is intended that the guidance systems employed will keep coach 10 spaced from all tracks. Nevertheless, extreme turbulence or gusts of wind may cause abrupt movements of coach 10. Upper wheels 40 may be extended under more turbulent conditions so as to limit upward movement of coach 10. Because the force of such upward movement is likely to be less than downward forces and of a transitory nature, upper wheels 40 need not be as sturdy as lower wheels 38.

Tracks 22, as shown in the detail of FIG. 3, include sloped upper and lower sides 42 and 44 respectively. Sloped sides 42 and 44 cooperate with upper and lower rollers 46 and 48 associated with side wheels 50. Rollers 46–48 in cooperation with sloped sides 42–44 prevent coach from rolling. Actuating arm 52 has a clevis type arrangement 54 supporting wheel 50 and rollers 46–48.

Returning to FIGS. 1 and 2, coach 10 has longitudinally spaced pylons 66 extending vertically upwardly from the center of the top of the coach to project through the open area 28 at the top of framework members 12 between the top tracks 26. Each pylon 66 supports an airfoil shaped stub wing with coach 10 having three such stub wings 68, 70 and 72. Stub wings 68–72 extend laterally above short segments 24 of framework members 12 and coach 10 to provide lift to support the weight of coach 10. An appropriate number of pylons and stub wings are utilized for the weight of the particular coach. The stub wings provide sufficient lift when coach 10 is traveling at speeds within the free flight design range for the coach.

Any suitable motive power may be provided to drive coach 10 within framework members 12 at the designed speeds to maintain coach 10 in a free flight condition within tunnel 30. For example, a jet engine at the rear end of coach 10 may be provided. It will also be apparent that if desired, spaced jet engines on opposite sides of coach 10 may be employed. These jet engines can be positioned at the location on coach 10 that is best suited to provide the desired thrust and to provide correctional guidance off the coach within framework members 12. As shown, the primary jet engine used for propulsion includes air intakes 74 located on each side of coach 10 and exhaust 76 located at the rear of coach 10. Coach 10 also includes an auxiliary jet engine at the front of coach 10 having air intake 78 and exhaust 80.

Guidance of coach 10 within framework members 12 and the imaginary tunnel 30 is responsive to a system of location and proximity sensors which may be carried on coach 10, intersperced along the trackway system, or they may be carried by the members 12. These sensors provide signals to the computer in coach 10 to control the actuation of ailerons 82, flaps 84, rudders 86, elevators 88 and other controls. The sensors provide information to the computer as to the location along imaginary tunnel 30 of coach 10 and also its proximity to framework members 12. The location information is used by the computer primarily for the purposes of controlling acceleration, steady flight and deceleration. The proximity information is used to correct the proximity of coach 10 relative to framework members 12 so that it maintains a generally central position.

Figure 4:
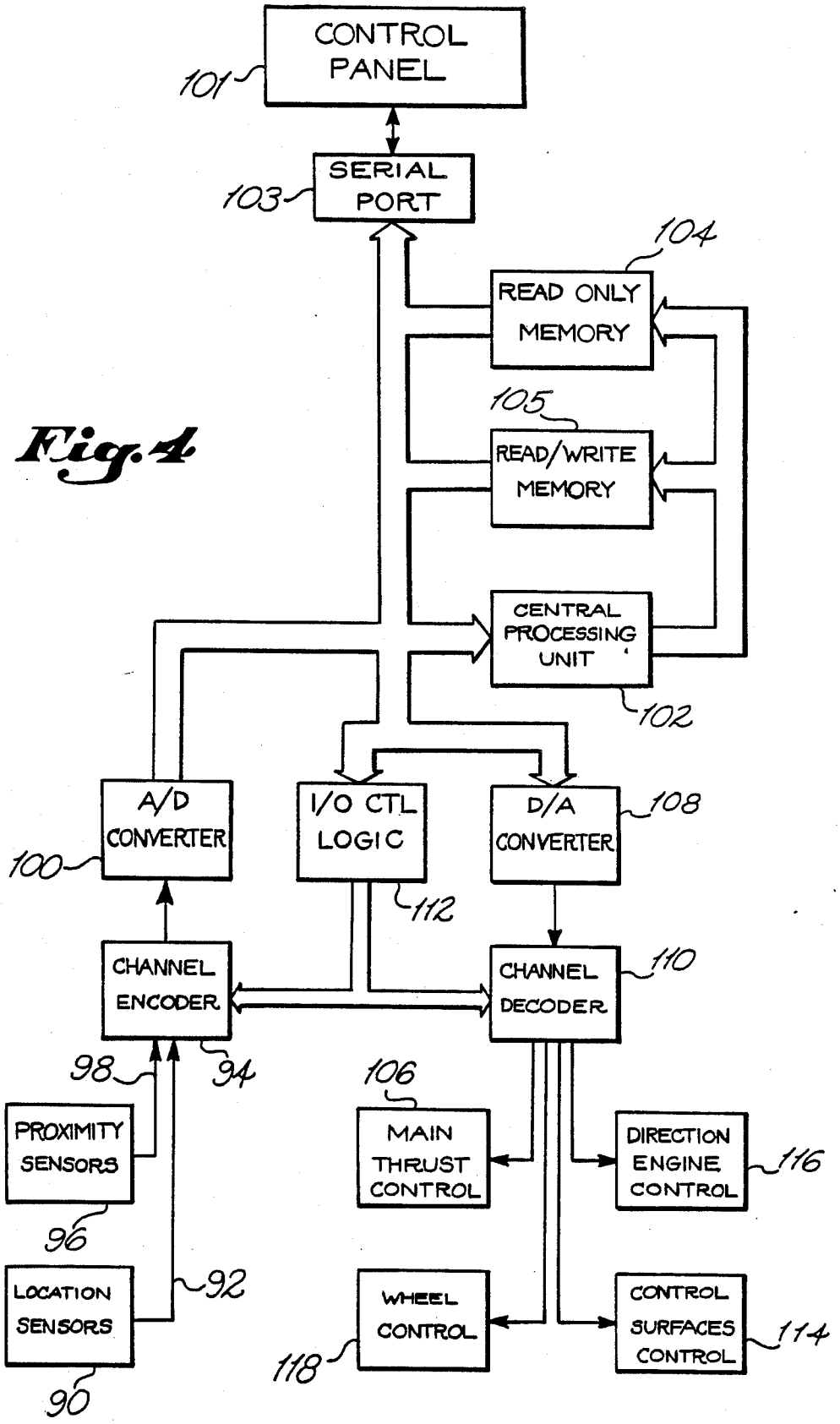
FIG. 4 is a block diagram of a control system for operation of the system of this invention.

Referring now to FIG. 4, a preferred embodiment of the control system for coach 10 will be described. Location sensors 90 may constitute devices which project a beam of light laterally which will impinge upon framework members 12 and be reflected back to sensors 90. Location sensors 90 produce an electrical signal upon each occurrence of such a reflection. The signals produced by sensors 90 are transmitted on line 92 to channel encoder 94. Since the number of framework members along the path to be traveled by coach 10 is known, maintaining a count of the framework members passed will provide the location of the coach. Other techniques for determining the location of a coach along a path and for controlling its operation accordingly are well known. See for example U.S. Pat. No. 4,302,811, entitled: "Automatic Train Operation with Position Stop and Velocity Control".

Proximity sensors 96 are carried by coach 10 and produce analog signals representative of the proximity of each such sensor from tracks 18, 22 or 26. These signals are transmitted to channel encoder 94 over line 98.

The signals received by channel encoder 94 are transmitted to analog to digital converter 100, for example sequentially. A/D converter 100 converts all analog signals into digital form and transmits them to central processing unit 102. Associated with central processing unit 102 is read only memory 104, which contains benchmark speeds for locations along the path defined by tunnel 30. An operator using control panel 101, transmits through serial port 103 data to read/write memory 105 which may be a random access memory. The data transmitted by the operator identifies the trip to be taken and CPU 102 accordingly selects the appropriate data from ROM 104. CPU 102 compares the actual coach speed with the benchmark speed and produces commands for more power, less power or the same power. which are delivered to main thrust control 106. In a similar manner, signals from proximity sensors 96 are compared with benchmark quantities to determine deviations if any from the prescribed amounts. Actuating commands are produced by CPU 102 in response to deviations and are delivered to digital to analog converter 108 for conversion into analog form. The analog signals are sent to channel decoder 110, which directs input and output control logic 112 to transmit the signals to the appropriate control system. I/O control logic 112 also directs the transmission of signals by channel encoder 94.

In addition to the main thrust control syste, there are three additional control systems for guidance of coach 10. The primary guidance system uses the control air foil type surfaces which have been previously discussed, i.e. the ailerons, flaps, rudders and elevators. These control surfaces operate in the well known manner in which they operate on fixed wing aircraft. Rudders 86 are pivotally mounted on pylons 66 and serve to control yaw. Ailerons 82 are pivotally mounted near the outboard edges of stub wings 68–72 and are used to control roll. Elevators 88 are pivotally mounted on stub wing 72 and are used to change the angle of attack. Flaps 84 are mounted on stub wings 68 and 70 and are used to increase lift at lower velocities for landings and takeoffs (if needed). Movement of these control surfaces, as well as the extension and retraction of the wheels of coach 10 may be accomplished using a hydraulic actuating arm operating system, which will be discussed below.

When CPU 102 compares the proximity information received from proximity sensors 96 to the proximity information stored in ROM 104 and determines that a deviation exists, CPU 102 directs the appropriate control system to provide corrections. The largest corrections are performed by the control surfaces of coach 10. Thus commands will be delivered to control surfaces control 114 when such corrections are required. Smaller adjustments in the orientation and position of coach 10 are performed by delivery of commands to direction engine control 116. Wheel control 118 is directed to extend the appropriate wheels on coach 10, when the control surfaces control 114 and direction engine control 116 will not maintain appropriate spacing of coach 10 from the tracks. This might occur under extreme turbulence conditions.

Figure 5:
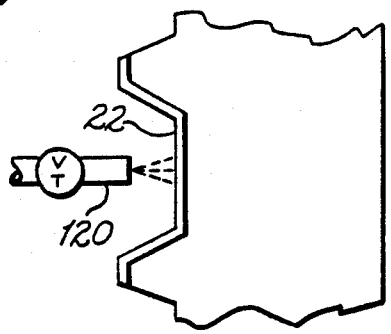
FIG. 5 represents schematically a gas jet directional control.

Direction engine control 116 provides controls to the auxiliary jet engine so that portions of its gaseous by-products are diverted from exhaust 80 to be expelled from nozzles such as nozzle 120 shown in FIG. 5. Normally, as nozzles will expel continuous equal flows. As indicated in FIGS. 1 and 5, nozzles 120 may be positioned on coach 10 so that the exhaust gases impinge upon the tracks, such as track 22. It is necessary that by using combinations of nozzles 120 located around the periphery of coach 10 that net reactive forces will be produced to move coach 10 in the desired direction relative to the tracks, so as to keep it centrally positioned. These net reactive flows are typically achieved by using valves (not shown) to restrict flow on nozzles in one direction and increasing flow on nozzles in the opposite direction.

Refering now to FIG. 6 a hydraulic arm actuating system will be described. Both the movable airfoil control surfaces, and the wheels require a method for moving them back and forth, and for holding them in a desired position. Actuating arm 122 is caused to move in the directions indicated by the arrows, by pumping hydraulic fluid from reservoir 124 using pump 126 through directional valve 128 to one end or the other of cylinder 130, while simultaneously venting fluid from the opposite end of the cylinder through valve 128 to reservoir 124. Piston 132, which is connected to actuating arm 122, moves away from the end of cylinder 130 into which pump 126 is pumping fluid. It will be observed that rotation of valve 128 one-quarter turn clockwise will cause fluid to be pumped into the opposite end of cylinder 130.

Figure 6:
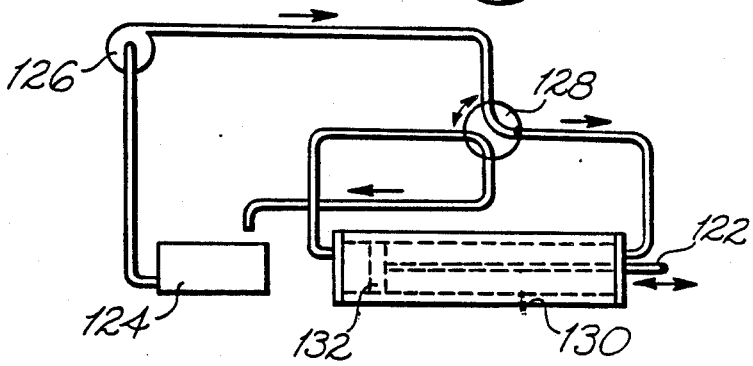
FIG. 6 represents schematically a hydraulic actuating arm operating system.
Figure 7:
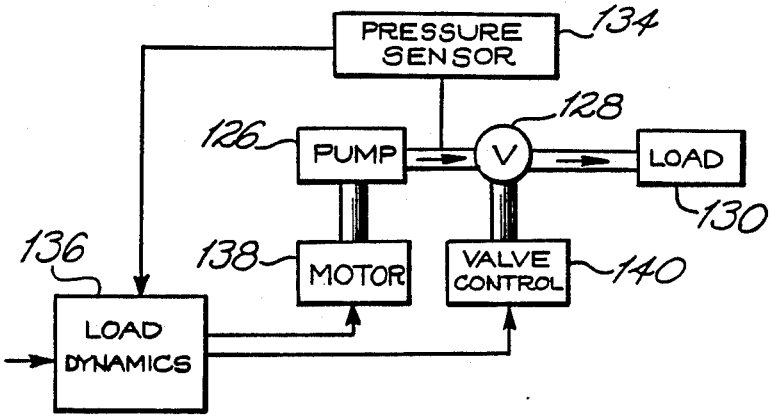
FIG. 7 is a control system for the operating system of FIG. 6.

FIG. 7 shows a control system for operating the hydraulic actuating arm system of FIG. 6. Pressure sensor 134 provides a signal representative of the pressure of the hydraulic fluid being pumped to load dynamics 136. Load dynamics 136 receives a command from channel decoder 110 representing the desired pressure to be delivered to the load and the direction in which the pressure should be exerted. Motor 138 drives pump 126 to produce the pressure and valve control 140 moves valve 128 so that the hydraulic fluid will be delivered to the proper end of load 130.

The operation is as follows: When coach 10 is standing while loading or unloading passengers and cargo, wheels 38 rest in the concave portions of bottom tracks 18. When the coach is ready to move, the engine 76 is started and coach 10 accelerates in imaginary tunnel 30. When coach 10 gains sufficient speed, elevators 88 are moved to cause coach 10 to rise off tracks 18 and the coach proceeds in flight through the imaginary tunnel 30. A constant feedback from location and proximity sensors 90 and 96 respectively, supplies CPU 102 with the data for instituting necessary commands. It will be recognized that corrections will be needed to compensate for changes in elevation as when going up and down hill and in negotiating curves. In addition, cross winds and other turbulence may create a need for correction. Where the corrections needed are minor, the direction engine control system jets may be adequate for making corrections.

If the jets and airfoil control surfaces cannot provide sufficient corrective forces to maintain the coach in the proper alignment in the imaginary tunnel 30, the top, bottom and side wheels may be extended to engage in their associated tracks. These wheels are used in combination with the jets in providing corrective forces.

While the instant invention has been shown and described herein in what is conceived to be the most practical and preferred embodiment, it is recognized that departues may be made therefrom within the scope of the invention, which is therefore not to be limited to the details disclosed herein, but is to be afforded the full scope of the claims so as to embrace any and all equivalent apparatus and articles.

I claim:

1. A transportation system comprising:

longitudinally spaced, open topped framework members;

longitudinally extending bottom, side and top tracks defining an open trackway system supported within said framework members, said tracks serving as the only connection between said frame work members;

a passenger carrying coach in said trackway system;

power means to propel said coach in said trackway system;

longitudinally spaced pylons carried by said coach and adapted to project through the open top of said framework members;

airfoil shaped stub wings carried by said pylons and adapted, when said coach is traveling at predetermined speeds, to provide sufficient lift to support said coaches in a free flight condition within said trackway system;

sensor means carried by said coach for providing signals for determining the position and movement of said coach relative to said trackway system;

memory means carried by said coach for containing desired coach position and movement information;

computer means carried by said coach for comparing the signals provided by said sensor means to the information contained in said memory means and for producing consequential control commands; and control surface means carried by said coach and moveable in response to said control commands for causing movement of said coach.

2. A transportation system in accordance with claim 1 further including:

main thrust control means carried by said coach and actuated in response to said control commands for causing said power means to produce a desired propulsion.

3. A transportation system in accordance with claim 1 further including:

direction engine means for producing pressurized gas;

nozzles connected to receive pressurized gas from said direction engine; and direction engine control means carried by said coach and actuated in response to said control commands for causing jets of gas to be expelled from selected ones of said nozzles.

4. A transportation system in accordance with claim 1 further including:

wheel means carried by said coach for controllable engagement with said tracks; and wheel control means carried by said coach and moveable in response to said control commands for engaging and disengaging said tracks.

5. A transportation system in accordance with claim 1 wherein:

said control surface means includes rudder means mounted on said pylons and ailerons, flaps and elevators mounted on said stub wings.

6. A transportation system in accordance with claim 5 wherein:

said coach has at least a forward and an aft stub wing;

said ailerons and flaps are mounted on said forward stub wing; and said elevators are mounted on said aft stub wing.

7. A transportation system in accordance with claim 1 wherein:

said memory means includes a read only memory and a random access memory; and said computer means includes a central processing unit.

8. A transportation system comprising:

longitudinally spaced, open topped framework members;

longitudinally extending bottom, side and top tracks defining an open trackway system supported by and within said framework members, said track serving as the only connection between said framework members;

said tracks having laterally extending concave central sections terminating in outwardly extending flanges;

a passenger carrying coach in said trackway system;

power means to propel said coach in said trackway system;

longitudinally spaced pylons carried by said coach and adapted to project through the open top of said framework members;

rudders moveably mounted on said pylons;

airfoil shaped stub wings carried by said pylons and adapted, when said coach is traveling at predetermined speeds, to provide sufficient lift to support said coaches in a free flight condition within said trackway system;

ailerons moveably mounted on the outboard edges of said stub wings;

elevators moveably mounted on the aftmost of said stub wings;

flaps moveably mounted on at least the forwardmost of said stub wings;

a direction engine producing pressurized gas;

nozzles connected to receive pressurized gas from said direction engine;

wheel means carried by said coach for controllable engagement with said tracks;

sensor means carried by said coach for providing signals for determining the position and movement of said coach relative to said trackway system;

memory means carried by said coach for containing desired coach position and movement information;

computer means carried by said coach for comparing the signals provided by said sensor means to the information contained in said memory means and for producing consequential control commands;

said rudders, ailerons, elevators and flaps being moveable in response to said control commands for causing movement of said coach;

said nozzles actuated in response to said control commands for causing jets of gas to be expelled from selected ones of said nozzles; and said wheel means moveable in response to said control commands for engaging and disengaging said tracks.

9. A transportation system in accordance with claim 8 wherein:

said wheel means includes side wheels extending from each side of said coach;

said side wheels being rotatably mounted in a clevis having upper and lower support members;

upper and lower rollers supported by said upper and lower support members of said clevis and cooperating with said outwardly extending flanges of said side tracks to limit roll of said coach.

10. A transportation system in accordance with claim 8 further including:

hydraulically operated actuating arms associated with said moveable control members;

a piston associated with each of said actuating arms;

said piston moveably contained in a hydraulic cylinder;

a source of pressurized hydraulic fluid; and control means for directing said hydraulic fluid to one side of said piston within said cylinder, while releasing it from the other side of said piston.

* * * * *